US007220326B2

(12) United States Patent
Beck et al.

(10) Patent No.: US 7,220,326 B2
(45) Date of Patent: May 22, 2007

(54) NICKEL-BASE ALLOY

(75) Inventors: Cyril Gerard Beck, Greenville, SC (US); John Herbert Wood, St. Johnsville, NY (US); Stephen Daniel Graham, Simpsonville, SC (US); Warren Tan King, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 533 days.

(21) Appl. No.: 10/065,217

(22) Filed: Sep. 26, 2002

(65) Prior Publication Data

US 2005/0178480 A1 Aug. 18, 2005

(51) Int. Cl.
*C22C 19/05* (2006.01)

(52) U.S. Cl. ..... 148/428; 420/448; 420/449

(58) Field of Classification Search ..... 420/447, 420/448, 449; 148/410, 428
See application file for complete search history.

(56) References Cited

U.S. PATENT DOCUMENTS 4,039,330 A * 8/1977 Shaw ..... 420/448
4,810,467 A 3/1989 Wood et al. ..... 420/448
6,106,767 A * 8/2000 Kennedy et al. ..... 420/448
6,258,317 B1 * 7/2001 Smith et al. ..... 420/448

* cited by examiner

*Primary Examiner*—John P. Sheehan
(74) *Attorney, Agent, or Firm*—Earnest Cusick; Gary M. Hartman; Domenica N. S. Hartman

(57) ABSTRACT

A family of castable and weldable nickel-base alloys that exhibit a desirable balance of strength and resistance to corrosion and oxidation suitable for gas turbine engine applications. A first alloy consists essentially of, by weight, 1 8% to 20% cobalt, 22.2% to 22.8% chromium, 1.8% to 2.2% tungsten, greater than 1.5% to 2.3% aluminum, 1.6% to 2.4% titanium, where the sum of aluminum and titanium is 2.8% to 4.4%, 0.7% to 0.9% columbium, 0.9% to 1.9% tantalum, 0.003% to 0.009% boron, 0.002% to 0.02% zirconium, 0.05% to 0.10% carbon, with the balance essentially nickel and incidental impurities. A second alloy consists essentially of, by weight, 5% to 8% cobalt, 22.2% to 22.8% chromium, 1.8% to 2.2% tungsten, 1.2% to 2.3% aluminum, 1.6% to 2.4% titanium, where the sum of aluminum and titanium is 2.8% to 4.4%, 0.7% to 0.9% columbium, 0.9% to 1.9% tantalum, 0.003% to 0.009% boron, 0.002% to 0.02% zirconium, 0.05% to 0.10% carbon, with the balance essentially nickel and incidental impurities.

8 Claims, 2 Drawing Sheets

NICKEL-BASE ALLOY

BACKGROUND OF INVENTION

1. Field of the Invention

The present invention generally relates to nickel-base alloys. More particularly, this invention relates to castable and weldable nickelalloys exhibiting desirable properties suitable for gas turbine engine applications.

2. Description of the Related Art

The superalloy GTD-222 (U.S. Pat. No. 4,810,467) has a number of desirable properties for gas turbine engine applications, such as nozzles (vanes) in the latter (second and third) stages of the turbine section. The nominal composition of GTD-222 is, by weight, about 19% cobalt, about 22.5% chromium, about 2% tungsten, about 1.2% aluminum, about 2.3% titanium, Al+Ti of about 3.5%, about 0.8% columbium (niobium) about 1.0% tantalum, about 0.01% boron, about 0.01% zirconium, about 0.1% carbon, with the balance essentially nickel and incidental impurities. As with the formulation of other nickelalloys, the development of GTD-222 involved careful and controlled adjustments of the concentrations of certain critical alloying elements to achieve a desired mix of properties. For use in turbine nozzle applications, such properties include high temperature strength, castability, weldability, and resistant to low cycle fatigue, corrosion and oxidation. Unfortunately, when attempting to optimize any one of these desired properties, other properties are often adversely affected. A particular example is weldability and creep resistance, both of which are of great importance for gas turbine engine nozzles. However, greater creep resistance results in an alloy that is more difficult to weld, which is necessary to allow for repairs by welding.

A desirable combination of creep strength and weldability exhibited by GTD-222 is believed to be the result of the use of judicious levels of aluminum, titanium, tantalum and columbium in the alloy. Each of these elements participates in the gamma prime (γN) precipitation-strengthening phase ($Ni_3(Ti,Al)$). Aluminum and titanium are the key elements in the formation of the gamma-prime phase, while the primary role of tantalum and columbium is to participate in the MC carbide phase. Tantalum and columbium remaining after MC carbide formation plays a lesser but not insignificant role in the formation of the gamma-prime phase.

As noted above, GTD-222 is well suited for use in latter stage gas turbine engine nozzle applications. However, the thermal environment of second stage nozzles can be sufficiently severe to require an oxidation-resistant coating, a thermal barrier coating (TBC), and/or internal cooling. The properties of GTD-222 are sufficient to allow third stage nozzles to achieve the required design life without such additional measures. In view of these differences, it would be desirable if a family of alloys were available that were more closely matched to the properties required for second and third stage nozzles of gas turbine engines.

SUMMARY OF INVENTION

The present invention provides a family of alloys that exhibit a desirable balance of strength (creep resistance) and resistance to corrosion and oxidation suitable for nozzles of the latter stages of a gas turbine engine, particularly the second and third stage nozzles. The alloys are also castable, relatively easy to weld in order to satisfy repair demands, substantially immune to metallurgical instability, and have acceptable heat treatment requirements. These desirable properties are achieved with a family of nickelalloys having carefully controlled amounts of cobalt and precipitation hardening elements different from the GTD-222 alloy for which these alloys are advancements, as well as controlled amounts of other elements generally in accordance with the GTD-222 alloy.

According to a first aspect of the invention, a castable weldable nickelalloy is provided that consists essentially of, by weight, about 1 8% to about 20% cobalt, about 22.2% to about 22.8% chromium, 1.8% about to about 2.2% tungsten, greater than 1.5% to about 2.3% aluminum, about 1.6% to about 2.4% titanium, where the sum of aluminum and titanium is about 2.8% to about 4.4%, about 0.7% to about 0.9% columbium, 0.9% to about 1.9% tantalum, about 0.003% to about 0.009% boron, about 0.002% to about 0.02% zirconium, about 0.05% to about 0.10% carbon, with the balance essentially nickel and incidental impurities. Such an alloy is particularly suitable in terms of improved creep strength, metallurgical stability and oxidation resistance required for second stage turbine nozzles.

According to a second aspect of the invention, a castable weldable nickelalloy is provided consisting essentially of, by weight, about 5% to about 8% cobalt, about 22.2% to about 22.8% chromium, about 1.8% to about 2.2% tungsten, about 1.2% to about 2.3% aluminum, about 1.6% to about 2.4% titanium, where the sum of aluminum and titanium is about 2.8% to about 4.4%, about 0.7% to about 0.9% columbium, 0.9% to about 1.9% tantalum, about 0.003% to about 0.009% boron, about 0.002% to about 0.02% zirconium, about 0.05% to about 0.10% carbon, with the balance essentially nickel and incidental impurities. Such an alloy exhibits a level of creep strength and other properties suitable for third stage turbine nozzles.

The benefits described above are believed to be achieved by adjusting the ratios of the hardening alloy elements, namely, aluminum, titanium, tantalum and columbium, with or without adjusting the cobalt content. Other advantages of the family of alloys of this invention include castability, weldability and relatively uncomplicated heat treatment requirements, which render the alloys suitable for a variety of high temperature applications, in addition to nozzle applications for gas turbine engines.

Other objects and advantages of this invention will be better appreciated from the following detailed description.

DETAILED DESCRIPTION

Figure 1:
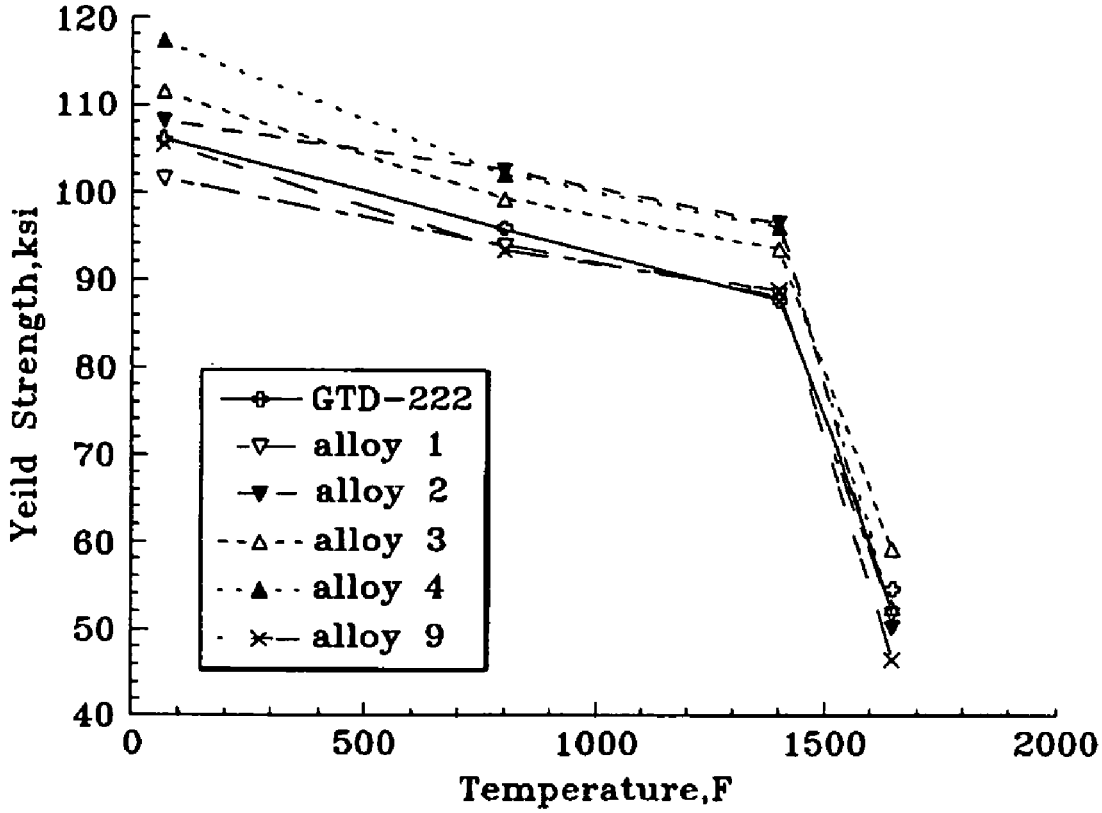
FIGS. 1 and 2 are graphs plotting yield strength versus temperature for alloys evaluated during an investigation leading to the present invention.

The present invention was the result of an effort to develop nickel-base alloys having chemistries that are carefully balanced to yield desirable levels of creep strength, metallurgical stability and oxidation resistance, while also substantially maintaining or improving such properties as weldability and castability relative to the nickelalloy commercially known as GTD-222 and disclosed in U.S. Pat. No. 4,810,467, which is incorporated herein by reference. The investigation resulted in the development of nickel-base alloys whose properties are particularly desirable for nozzles used in the second or third turbine stages of a gas turbine engine. The approach of the investigation was to radically alter the minor alloying elements of GTD-222 that effect the gamma-prime precipitation hardening phase. In the investigation, various levels of aluminum and tantalum were evaluated to affect oxidation resistance and metallurgical stability, the latter of which is characterized by a reduced propensity for precipitation of the eta (η) phase ($Ni_3Ti$). The intent was also to alter carbon and titanium levels to reduce carbide and eta phase formation for the purpose of improving stability and weldability. Another aspect of the investigation was to alter the levels of aluminum and tantalum to expand and contract the volume fraction of gamma prime for the purpose of adjusting the creep resistance at elevated temperatures. The effect of cobalt reduction on strength was also evaluated, motivated in part by a desire to reduce material cost. Finally, the effect of a lower carbon level was investigated to determine its effect on castability.

The highstrength of a nickelsuperalloy is directly related to the volume fraction of the gammaphase, which in turn is directly related to the total amount of the gamma primeelements (aluminum, titanium, tantalum and columbium) present. Based on these relationships, the amounts of these elements required to achieve a given strength level can be estimated. The compositions of the gammaphase and other secondary phases such as carbides and borides, as well as the volume fraction of the gammaphase, can also be estimated based on the starting chemistry of the alloy and some basic assumptions about the phases which form. By such a procedure, it was concluded that an alloy having the desired level of creep strength for second stage nozzles should contain about 28 to about 32 volume percent of the gammaphase, while third stage nozzles could have a gamma-prime content of about 31 to about 36 volume percent.

Nine alloys having the approximate chemistries set forth in Table I below were formulated and cast during the investigation. Castings of the GTD-222 alloy were also prepared having the following approximate chemistry, by weight: 19% cobalt,about 22.5% chromium, about 2% tungsten, about 1.2% aluminum, about 2.3% titanium, about 0.8% cplumbium, about 1% tantalum, about 0.008% boron, about 0.022% zirconium, about 0.1% carbon, with the balance essentially nickel and incidental impurities. All of the specimens were in slab form prepared by conventional investment casting technique. No differences were noted in castability between the different alloys. Each specimen underwent a standard heat treatment cycle developed for GTD-222, including a solution heat treat at about 2100° F. (about 1150° C.) for about four hours in a vacuum, followed by a rapid quench to below about 1300° F. (about 700° C.). All specimens then underwent aging at about 1475° F. (about 800° C.) for about eight hours.

[t1]

TABLE I

| | Alloy #1 | Alloy #2 | Alloy #3 | Alloy #4 | Alloy #5 | Alloy #6 | Alloy #7 | Alloy #8 | Alloy #9 |
|---|---|---|---|---|---|---|---|---|---|
| Co | 6.56 | 6.61 | 6.47 | 6.46 | 18.81 | 18.84 | 18.76 | 18.63 | 12.80 |
| Cr | 22.63 | 22.67 | 22.33 | 22.15 | 22.09 | 22.90 | 22.59 | 22.40 | 22.97 |
| W | 1.97 | 1.96 | 1.96 | 1.95 | 1.99 | 1.99 | 1.99 | 1.98 | 1.98 |
| Al | 1.44 | 2.24 | 1.44 | 2.26 | 1.26 | 2.21 | 1.24 | 2.26 | 1.35 |
| Ti | 1.61 | 1.60 | 2.18 | 2.23 | 1.71 | 1.68 | 2.30 | 2.27 | 1.66 |
| Al + Ti | 3.05 | 3.84 | 3.62 | 4.49 | 2.97 | 3.89 | 3.54 | 4.53 | 3.01 |
| Cb | 0.78 | 0.78 | 0.78 | 0.78 | 0.78 | 0.78 | 0.78 | 0.78 | 0.77 |
| Ta | 1.56 | 1.58 | 1.57 | 1.57 | 1.63 | 1.61 | 1.63 | 1.63 | 1.59 |
| B | 0.0024 | 0.0028 | 0.0026 | 0.0024 | 0.0050 | 0.0054 | 0.0052 | 0.0054 | 0.0036 |
| Zr | 0.005 | 0.005 | 0.006 | 0.005 | 0.005 | 0.006 | 0.005 | 0.006 | 0.006 |
| C | 0.06 | 0.06 | 0.06 | 0.06 | 0.07 | 0.07 | 0.07 | 0.07 | 0.07 |
| Ni | bal. | bal. | bal. | bal. | bal. | bal. | bal. | bal. | bal. |
| Y' (%) | 26 | 31 | 29 | 34 | 28 | 34 | 30 | 36 | 27 |

The above alloying levels were selected to reflect cobalt levels comparable to and lower than GTD-222 (alloys 5-8 versus alloys 1-4 and 9, respectively), aluminum levels comparable to and higher than GTD-222 (alloys 1, 3, 5 and 7, versus alloys 2, 4, 6, 8 and 9, respectively), and titanium levels comparable to and lower than GTD-222 (alloys 3, 4, 7 and 8, versus alloys 1, 2, 5, 6 and 9, respectively). In addition, alloys 1 -9 were formulated to have higher tantalum levels (about 1.6%) compared to GTD-222 (about 1%). Notably, the atomic percent ratios of aluminum to titanium in the evaluated alloys were not the same as that of GTD-222 (about 0.91), which U.S. Pat. No. 4,810,467 taught as being a critical aspect in terms of achieving metallurgical stability and other desired properties of the GTD-222 alloy.

Following heat treatment, some of the specimens were evaluated for weldability by forming hemispherical indentations of different diameters in their surfaces, and then filling the indentations using standard welding parameters for GTD-222. The filled indentations were then cross-sectioned and examined for weld quality. All of the specimens exhibited acceptable weld properties comparable to GTD-222.

Tensile properties of the alloys were determined with standard smooth bar specimens machined from the cast slabs. The data are summarized below in Tables II, III, IV and V, wherein "UTS" is ultimate tensile strength, "YS" is 0.2% yield strength, "EL" is elongation, and "RA" is reduction in area.

[t2]

TABLE II

| Properties at 70° F. (about 20° C.) | | | | | | | | | |
|---|---|---|---|---|---|---|---|---|---|
| | Alloy #1 | Alloy #2 | Alloy #3 | Alloy #4 | Alloy #5 | Alloy #6 | Alloy #7 | Alloy #8 | Alloy #9 |
| UTS (ksi) | 141.3 | 151.0 | 153.8 | 151.6 | 152.4 | 164.0 | 160.3 | 158.8 | 145.6 |
| YS (ksi) | 101.5 | 108.1 | 111.5 | 117.3 | 108.9 | 116.1 | 117.9 | 121.7 | 105.5 |
| EL (%) | 12.8 | 8.5 | 8.9 | 6.3 | 14.3 | 12.4 | 11.9 | 7.5 | 14.7 |
| RA (%) | 17.0 | 11.2 | 11.6 | 9.1 | 17.1 | 14.4 | 15.6 | 9.6 | 16.3 |

[t3]

TABLE III

| Properties at 800° F. (about 425° C.) | | | | | | | | | |
|---|---|---|---|---|---|---|---|---|---|
| | Alloy #1 | Alloy #2 | Alloy #3 | Alloy #4 | Alloy #5 | Alloy #6 | Alloy #7 | Alloy #8 | Alloy #9 |
| UTS (ksi) | 136.3 | 142.0 | 129.4 | 132.7 | 126.6 | 139.8 | 135.5 | 133.1 | 134.1 |
| YS (ksi) | 93.8 | 102.5 | 99.2 | 102.2 | 91.4 | 104.4 | 107.5 | 104.1 | 93.3 |
| EL (%) | 18.0 | 9.2 | 6.9 | 6.1 | 14.8 | 9.3 | 8.7 | 6.9 | 19.8 |
| RA (%) | 19.6 | 12.6 | 12.6 | 12.1 | 21.5 | 13.5 | 13.7 | 13.9 | 25.3 |

[t4]

TABLE IV

| Properties at 1400° F. (about 760° C.) | | | | | | | | | |
|---|---|---|---|---|---|---|---|---|---|
| | Alloy #1 | Alloy #2 | Alloy #3 | Alloy #4 | Alloy #5 | Alloy #6 | Alloy #7 | Alloy #8 | Alloy #9 |
| UTS (ksi) | 119.0 | 124.3 | 115.8 | 129.3 | 120.5 | 131.0 | 118.3 | 132.0 | 122.5 |
| YS (ksi) | 88.2 | 96.4 | 93.4 | 96.0 | 89.1 | 103.0 | 101.7 | 104.7 | 88.8 |
| EL (%) | 10.0 | 7.9 | 8.0 | 7.9 | 13.3 | 7.7 | 4.4 | 6.3 | 12.4 |
| RA (%) | 14.7 | 8.4 | 11.0 | 13.6 | 15.8 | 10.9 | 7.0 | 8.7 | 15.4 |

[t5]

TABLE V

| Properties at 1650° F. (about 900° C.) | | | | | | | | | |
|---|---|---|---|---|---|---|---|---|---|
| | Alloy #1 | Alloy #2 | Alloy #3 | Alloy #4 | Alloy #5 | Alloy #6 | Alloy #7 | Alloy #8 | Alloy #9 |
| UTS (ksi) | 58.2 | 61.1 | 63.7 | 63.9 | 59.6 | 65.4 | 72.9 | 69.0 | 57.1 |
| YS (ksi) | 51.6 | 50.1 | 59.1 | 52.4 | 53.7 | 56.5 | 68.0 | 59.1 | 46.5 |
| EL (%) | 16.3 | 16.1 | 18.8 | 13.4 | 17.2 | 16.2 | 9.1 | 13.9 | 17.1 |
| RA (%) | 23.6 | 19.9 | 23.8 | 17.2 | 27.3 | 19.4 | 11.9 | 18.1 | 31.8 |

Figure 2:
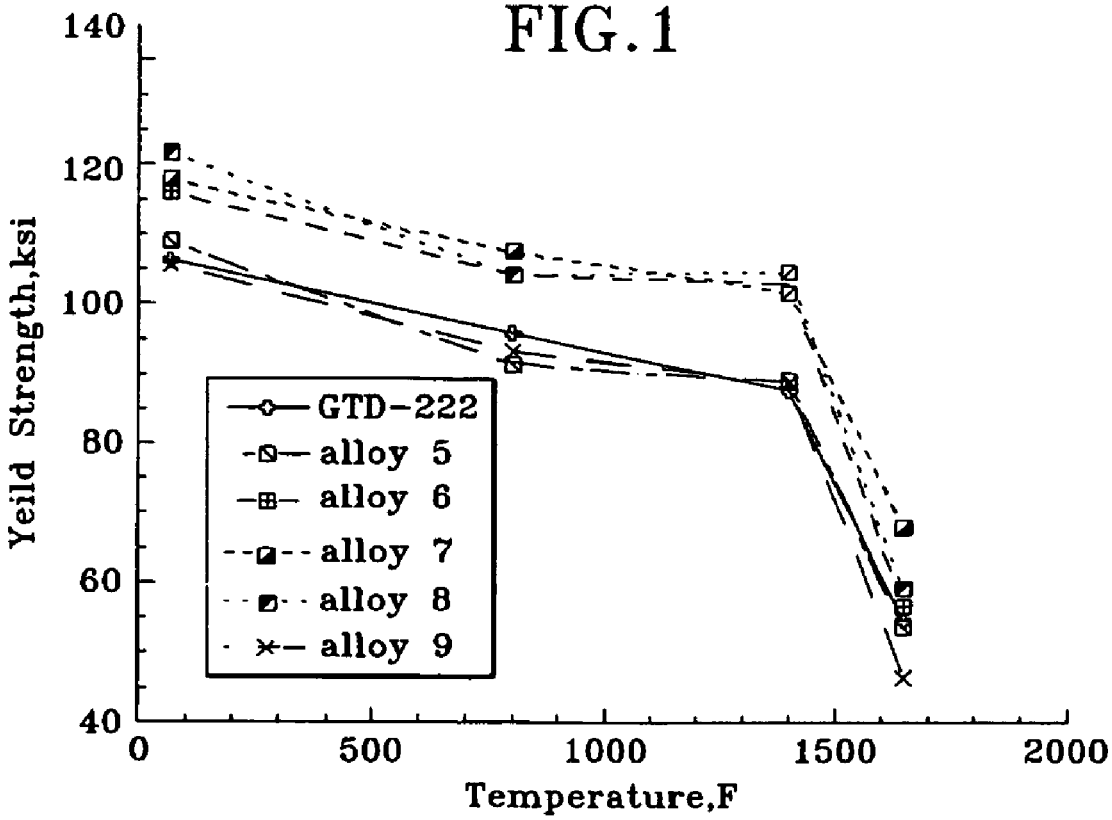

The effect of these alloying modifications on tensile properties can be visualized by plots of yield strength versus test temperature. FIG. 1 plots the 0.2% yield strength data of Tables II, III, IV and V for alloys 1 through 4 (each of which has a cobalt content of about 6.5 weight percent), alloy 9 (having a cobalt content of about 13), and the GTD-222 specimen. FIG. 2 plots the 0.2% yield strength data of Tables II, III, IV and V for alloys 5 through 8 (each of which has a cobalt content of about 19 weight percent), and again the GTD-222 specimen. FIGS. 1 and 2 evidence that alloys 2, 3, 4, 6, 7 and 8 exhibited better yield strength than alloys 1, 5 and 9, which had strengths comparable to the GTD-222 alloy.

By plotting separate graphs for specimens containing about 1.3 or 2.3 weight percent aluminum (alloys 1, 3, 5 and 7, and alloys 2, 4, 6 and 8, respectively), and for those containing about 1.6 or 2.2 weight percent titanium (alloys 1, 2, 5 and 6, and alloys 3, 4, 7 and 8, respectively), a trend appeared from which was concluded the following ranking of the alloys, highest to lowest, on the basis of yield strength: alloys 7, 6, 8, 2, 4 and 3, followed by alloys 1, 5 and 9 with similar strengths. While relationships were evident between strength and the amount of titanium (e.g., compare alloys 2 and 6) and cobalt (e.g., compare alloys 2 and 4) present, the results also evidenced that alloys containing relatively high levels of tantalum (about 1.6 weight percent) and aluminum (e.g., alloys 2, 4, 6 and 8, containing 2.21 to 2.26 weight percent aluminum) are capable of exhibiting better creep strength than GTD-222. A higher aluminum content would also be expected to improve oxidation resistance as a result of promoting the growth of a protect aluminum oxide (alumina) scale on the alloy surface at high temperatures.

In view of the above, it was concluded that alloys similar to GTD-222 but containing about 2.2 weight percent aluminum, about 1.6 weight percent tantalum, and either about 6.5 or about 1 9 weight percent cobalt are capable of exhibiting improved strength and oxidation resistance. Improved metallurgical stability is another benefit of the higher aluminum and tantalum content, as is improved stability and weldability in view of the ability to use lower titanium levels (about 1.6 weight percent). The relatively lower carbon level and relatively low zirconium level used in the alloys may also provide improved stability and weldability.

Figure 3:
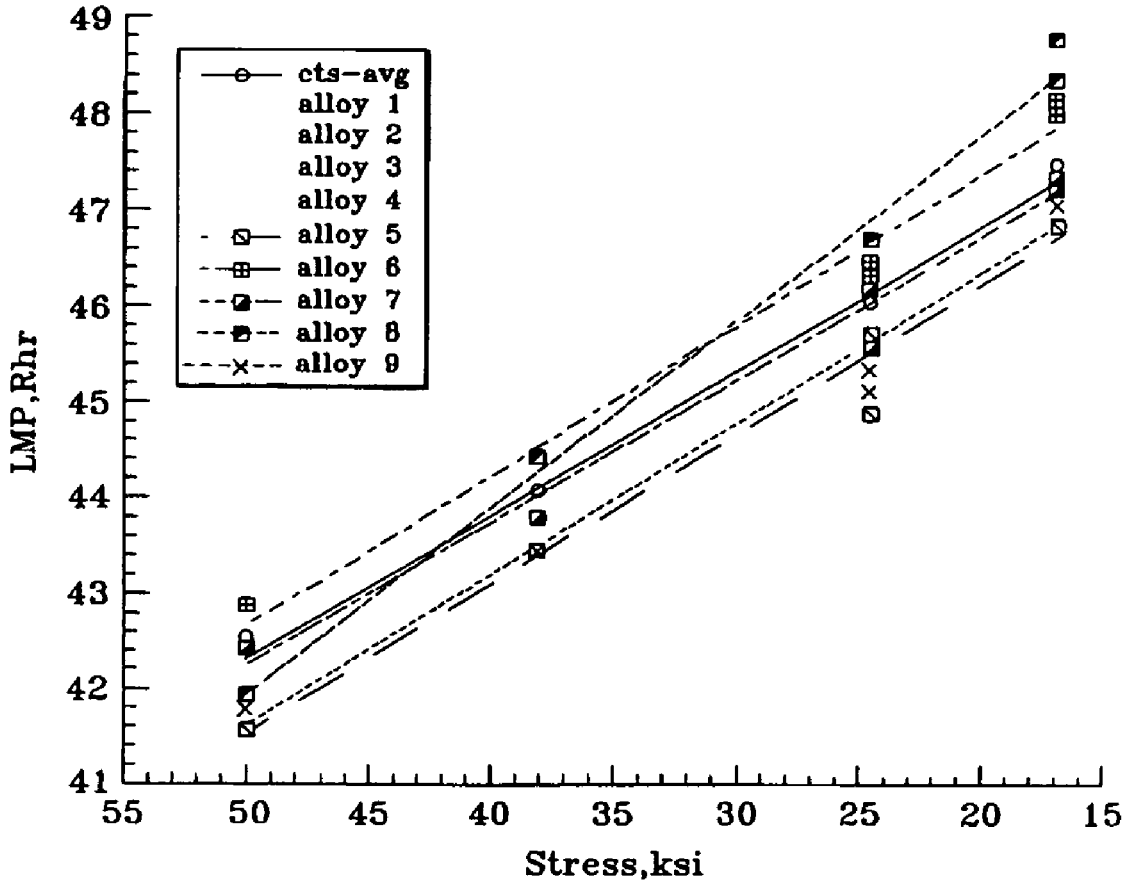
FIG. 3 is a graph plotting the Larson-Miller Parameter versus stress for alloys evaluated during the investigation leading to the present invention.

FIG. 3 plots the Larson-Miller Parameter (LMP) versus stress (1000 psi) for alloys 5 through 9, comparing stress rupture properties of the alloys based on the relationship $P=T(C+\log t)\times 10^{-3}$, where P is the time temperature parameter number, T is absolute test temperature in degrees Rankine, t is rupture time in hours, and C is the constant used (e.g., 20). Based on these results, the alloys were ranked, highest to lowest, on the basis of rupture time at a temperature of about 1550° F. (about 843° C.), as follows: alloys 8, 4, 2, 6, GTD-222, 3, 7, 9, 1 and 5. The even-numbered alloys have a higher aluminum content than the odd-numbered alloys, suggesting that aluminum content had a significant positive effect on creep strength.

On the basis of the above, two alloys were chosen as being well suited for nozzles of either the second or third turbine stage of a gas turbine engine. These alloys, designated alloy A and alloy B, respectively, are summarized in Table VI below in approximate weight percent. The primary distinction between Alloys A and B is the cobalt level.

[t6]

TABLE VI

| | Alloy A Range | Alloy A Nominal | Alloy B Range | Alloy B Nominal |
|---|---|---|---|---|
| Co | 18 to 20 | 19 | 5 to 8 | 6.5 |
| Cr | 22.2 to 22.8 | 22.5 | 22.2 to 22.8 | 22.5 |
| W | 1.8 to 2.2 | 2 | 1.8 to 2.2 | 2 |
| Al | 1.2 to 2.3 | 1.75 | 1.2 to 2.3 | 1.85 |
| Ti | 1.6 to 2.4 | 2 | 1.6 to 2.4 | 2 |
| Al + Ti | 2.8 to 4.4 | 3.75 | 2.8 to 4.4 | 3.75 |
| Cb | 0.7 to 0.9 | 0.8 | 0.7 to 0.9 | 0.8 |
| Ta | 0.9 to 1.9 | 1.5 | 0.9 to 1.9 | 1.5 |
| B | 0.003 to 0.009 | 0.005 | 0.003 to 0.009 | 0.005 |
| Zr | 0.002 to 0.020 | 0.005 | 0.002 to 0.020 | 0.005 |
| C | 0.05 to 0.10 | 0.07 | 0.05 to 0.10 | 0.07 |
| Ni | bal. | bal. | bal. | bal. |
| Y' (%) | 26 to 38 | 32 | 23 to 36 | 30 |

Requiring a lower limit of above 1.5 weight percent for the aluminum content distinguishes the ranges for the A and B alloys from the maximum disclosed aluminum content of 1.5 weight percent for the GTD-222 alloy. Alloy B is further distinguishable from the GTD-222 alloy as having a significantly lower cobalt content, prompting a higher preferred aluminum content for the B alloy. Of course, the higher tantalum content is also an important aspect of the A and B alloys.

The alloys identified above in Table VI can be satisfactorily heat treated using the treatment described above, though conventional heat treatments adapted for nickelalloys could also be used.

While the invention has been described in terms of a preferred embodiment, it is apparent that other forms could be adopted by one skilled in the art. Therefore, the scope of the invention is to be limited only by the following claims.

The invention claimed is:

1. Second and third stage nozzles installed in second and third turbine stages, respectively, of a gas turbine engine, the second turbine stage having a thermal environment that is more severe than the third turbine stage, the second and third stage nozzles being cast from first and second nickel-base alloys, respectively, each consisting of cobalt and, approximately by weight, 22.2% to 22.8% chromium, 1.8% to 2.2% tungsten, 1.2% to 2.3% aluminum, 1.6% to 2.4% titanium, the sum of aluminum and titanium being 2.8% to 4.4%, 0.7% to 0.9% columbium, 0.9% to 1.9% tantalum, 0.003% to 0.009% boron, 0.002% to 0.02% zirconium, 0.05% to 0.10% carbon, with the balance essentially nickel and incidental impurities;

wherein the first and second alloys only differ by having cobalt contents of, by weight, 18% to 20% and 5% to 8%, respectively.

2. The second and third stage nozzles according to claim 1 wherein the sum of aluminum and titanium in the first alloy is about 3.75%.

3. The second and third stage nozzles according to claim 1 wherein the aluminum content of the first alloy is about 1.75%.

4. The second and third stage nozzles according to claim 1 wherein the first alloy contains about 26 to about 38 volume percent of a gamma-prime precipitate phase.

5. The second and third stage nozzles according to claim 1 wherein the sum of aluminum and titanium in the second alloy is about 3.75%.

6. The second and third stage nozzles according to claim 1 wherein the aluminum content of the second alloy is about 1.85%.

7. The second and third stage nozzles according to claim 1 wherein the cobalt contents of the first and second alloys are about 19% and about 6.5%, respectively.

8. The second and third stage nozzles according to claim 1, wherein the second alloy contains about 23 to about 36 volume percent of a gamma-prime precipitate phase.

* * * * *